US006002419A

United States Patent [19]

Kerr et al.

[11] Patent Number: 6,002,419

[45] **Date of Patent: *Dec. 14, 1999**

[54] VACUUM IMAGING DRUM WITH AN OPTIMIZED SURFACE

[75] Inventors: Roger S. Kerr, Brockport; Dean L. Smith, Pittsford; Douglas A. Hons, Rochester, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/785,101

[22] Filed: Jan. 21, 1997

[51] Int. Cl.[6] ..... B41J 2/435; B41J 2/47

[52] U.S. Cl. ..... 347/233; 347/264

[58] Field of Search ..... 346/138; 271/275, 271/276; 347/215, 217, 218, 262, 264, 233; 503/227; 451/38, 40, 49, 51; 430/57.5; 399/302, 284, 159, 161

[56] References Cited

U.S. PATENT DOCUMENTS

| | | | |
|---|---|---|---|
| 3,630,424 | 12/1971 | Rau | 226/95 |
| 4,343,881 | 8/1982 | Sher et al. | 430/57.5 |
| 5,053,791 | 10/1991 | Baek et al. | 347/233 |
| 5,268,708 | 12/1993 | Harshbarger et al. | 346/134 |
| 5,341,159 | 8/1994 | Kerr | 347/212 |
| 5,600,420 | 2/1997 | Saito et al. | 399/302 |

*Primary Examiner*—N. Le
*Assistant Examiner*—L. Anderson
*Attorney, Agent, or Firm*—Nelson Adrian Blish; David A. Novais

[57] ABSTRACT

The present invention is for an imaging processing apparatus (10) for thermal print medium. The image processor apparatus (10) comprises a vacuum imaging drum (300) for holding thermal print media(32) and donor sheets (36) in registration on the vacuum imaging drum (300). A printhead (500) moves along a line parallel to a longitudinal axis X of the imaging drum (300) as the imaging drum (300) rotates. The printhead (500) receives information signals and produces radiation which is directed to the donor (36) which causes color to transfer from the donor (36) to the thermal print media (32). At least part of a surface of the vacuum imaging drum (300) has micropaths over at least a portion of a surface of the vacuum imaging drum (300). In one embodiment the micropaths are produced by sandblasting (330). At least one vacuum hole or slot is located on the surface of the vacuum imaging drum (300), connecting to the micropaths. The micropaths act in cooperation with the vacuum holes (306) to increase the force holding sheets of thermal media (32) and dye donor (36) material to the drum (300), allowing higher rotational speeds.

18 Claims, 7 Drawing Sheets

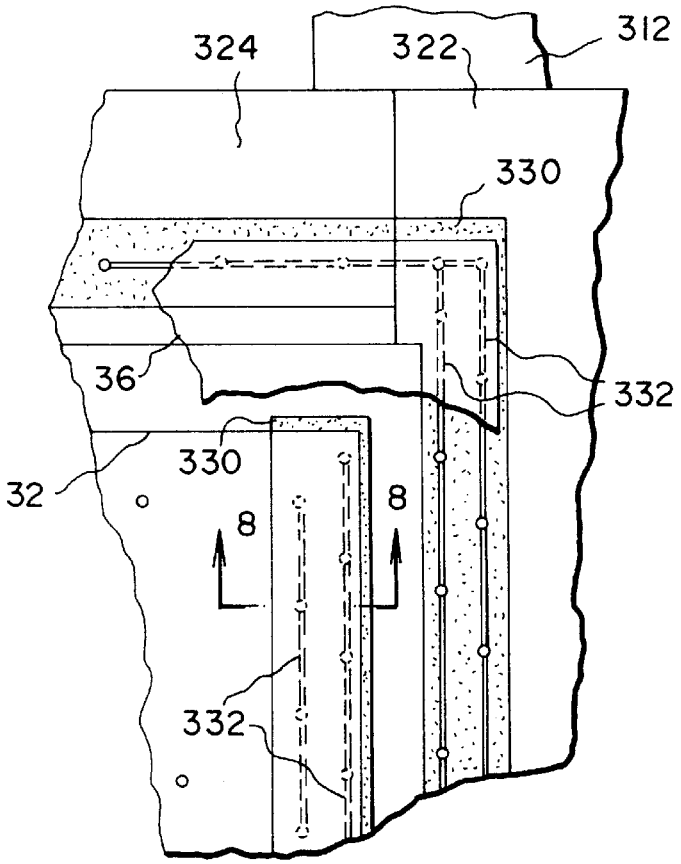
FIG. 7
FIG. 8
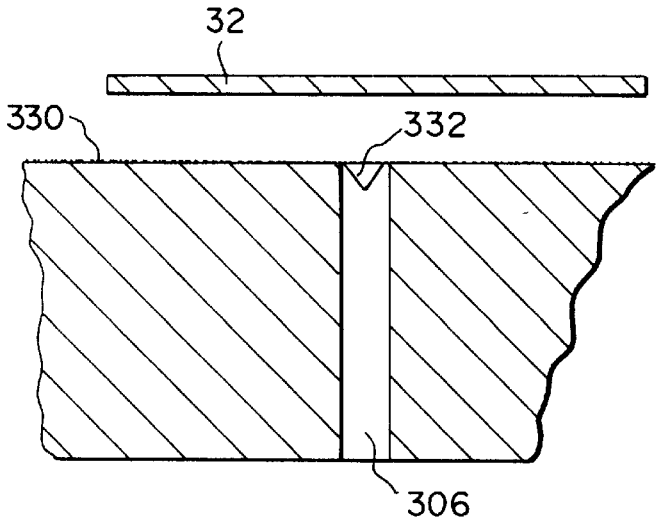

VACUUM IMAGING DRUM WITH AN OPTIMIZED SURFACE

BACKGROUND OF THE INVENTION

1. Field of The Invention

This invention relates to a subsystem of an image processing apparatus of the lathe bed scanning type for holding sheets of thermal media on a vacuum imaging drum and more specifically to holding sheet media on a revolving vacuum imaging drum whose surface has been optimized in selected areas to a specified roughness to increase the holding force applied to the media without increasing the vacuum applied to the drum.

2. Background Art

Color-proofing is a procedure that is used by the printing industry for creating representative images of the material to be printed without the high cost and time that is required to actually set up a high-speed, high volume, printing press to produce an example of an intended image which may need to be corrected to satisfy or meet the customers requirements resulting in a large loss of profits.

One such commercially available image processing apparatus, which is depicted in commonly assigned U.S. Pat. Nos. 5,268,708 and 5,341,159 is for an image processing apparatus having half-tone color proofing capabilities. This image processing apparatus is arranged to form an intended image on a sheet of thermal print media in which dye from a sheet of a dye donor is transferred to the thermal print media, by applying a sufficient amount of thermal energy to the dye donor to form the intended image. This image processing apparatus is comprised generally of a material supply assembly or carousel, lathe bed scanning subsystem or write engine (which includes a lathe bed scanning frame, translation drive, translation stage member, print head, and vacuum imaging drum); and a receiver and dye donor exit transports.

The operation of the image processing apparatus comprises metering a length of the thermal print media from a material assembly or carousel. The thermal print media is then measured and cut into sheet form of the required length and transported to the vacuum imaging drum, registered, wrapped around and secured onto the vacuum imaging drum. Next a length of dye donor (in roll form) is also metered out of the material supply assembly or carousel, then measured and cut into sheet form of the required length. It is then transported to and wrapped around the vacuum imaging drum, such that it is superposed in the desired registration with respect to the thermal print media (which has already been secured to the vacuum imaging drum).

After the dye donor is secured to the periphery of the vacuum imaging drum, the scanning subsystem or write engine provides the scanning function. This is accomplished by retaining the thermal print media and dye donor on the spinning vacuum imaging drum while it is rotated past the writing head. The translation drive then traverses the write head and translation stage member axially along the vacuum imaging drum, in coordinated motion with the spinning vacuum imaging drum. These movements combine to produce the intended image on the thermal print media.

After the intended image has been written on the thermal print media, the dye donor is then removed from the vacuum imaging drum. This is done without disturbing the thermal print media that is beneath it. The dye donor is then transported out of the image processing apparatus by the dye donor exit transport. Additional dye donors of a different color are sequentially superimposed with thermal print media on the vacuum imaging drum. These are then imaged onto the thermal print media as previously mentioned, until the intended image is completed. The completed image on the thermal print media is then unloaded from the vacuum imaging drum and transported to an external holding tray on the image processing apparatus by the receiver sheet material exit transport.

The material supply assembly comprises a carousel assembly mounted for rotation about its horizontal axis on bearings at the upper ends of vertical supports. The carousel comprises a vertical circular plate having six material support spindles. These support spindles are arranged to carry one roll of thermal print media receiver material, and four rolls of dye donor to provide the four primary colors used in the writing process to form the intended image, and one roll as a spare or for a specialty color. Each spindle has a feeder assembly to withdraw the thermal print media from the spindles to be cut into a sheet form. The carousel is then rotated about its axis into the desired position, so that the thermal print media receiver or dye donor (in roll form) can be withdrawn, measured, and cut into sheet form of the required length, and then transported to the vacuum imaging drum.

The write head includes a plurality of lasers diodes which are tied to a print-head and can be individually modulated to supply energy to selected areas of the thermal print media in accordance with an information signal. The write-head of the printer includes one end of a fiber optic array or print head, having a plurality of optical fibers coupled to the diode lasers. The write-head is movable relative to the longitudinal axis of the vacuum imaging drum. The dye is transferred to the thermal print media as the radiation, transferred from the diode laser to dye donor by the optical fibers, is converted to thermal energy in the dye donor.

Existing image processing apparatus designs employ a multi-chamberd vacuum imaging drum for lead-edge control. One appropriately controlled chamber applies vacuum that holds the lead edge of the thermal print media donor sheet material. Another chamber, separately valved, controls vacuum that holds the trail edge of the thermal print media, to the vacuum imaging drum. With this arrangement, loading a sheet of thermal print media receiver and dye donors require that the image processing apparatus feed the lead edge of the thermal print media receiver and dye donors into position just past the vacuum ports controlled by the respective valved chamber. Then vacuum is applied, gripping the lead edge of the a thermal print media receiver and dye donors against the vacuum imaging drum surface.

Unloading the thermal print media receiver and dye donors (to discard the used dye donors or to deliver the finished thermal print media to an output tray) requires the removal of vacuum from these same chambers so that an edge of the thermal print media receiver or dye donors are freed and project out from the surface of the vacuum imaging drum. The image processing apparatus then positions an articulating skive into the path of the free edge to lift the edge further and to feed the thermal print media receiver or dye donors, to a discard receptacle or an output tray.

The receiver and dye donor exit transports consist of a dye donor waste exit and the imaged receiver sheet material exit. The dye donor exit transport comprises a waste dye donor stripper blade disposed adjacent the upper surface of the vacuum imaging drum. In the unload position, the stripper blade is in contact with the waste dye donor on the vacuum imaging drum surface. When not in operation, the stripper blade is moved up and away from the surface of the vacuum imaging drum. A driven waste dye donor transport belt is arranged horizontally to carry the waste dye donors, which is removed by the stripper blade from the surface of the vacuum imaging drum to an exit formed in the exterior of the image processing apparatus. A waste bin for the waste dye donors is separate from the image processing apparatus. The imaged receiver sheet material exit transport comprises a movable receiver sheet material stripper blade that is disposed adjacent to the upper surface of the vacuum imaging drum. In the unload position, the stripper blade is in contact with the imaged thermal print media on the vacuum imaging drum surface. In the inoperative position, it is moved up and away from the surface of the vacuum imaging drum. A driven receiver sheet material transport belt is arranged horizontally to carry the imaged thermal print media removed by the stripper blade from the surface of the vacuum imaging drum. It then delivers the imaged thermal print media with the intended image formed thereon to an exit tray in the exterior of the image processing apparatus.

Although the presently known and utilized image processing apparatus is satisfactory, it is not without drawbacks. Throughput, measured by the number of intended images per hour, is, limited in part, by the vacuum imaging drums rotational speed. With some constraints imposed by the technology itself, the faster the vacuum imaging drum can rotate (without the centrifugal forces lifting or separating the thermal print media receiver and dye donors from each other or off from the vacuum imaging drum causing an image defects or resulting in a media jam and loss of the intended image or catastrophic damage to image processing apparatus), the faster the intended image can be exposed by the image processing apparatus onto the thermal print media the higher the throughput of the image processing apparatus will be increased.

However, with the existing image processing apparatus how the physical characteristics of the thermal print media and the dye donor interface with each other and to the circumferential recess limits the rotational speeds of the vacuum imaging drum that are possible. At high rotational speeds (in excess of 1000 RPM) of the vacuum imaging drum, increased air turbulence and centrifugal force can separate the dye donor from the thermal print media resulting in an image defect in the intended image, or lift the thermal print media receiver and dye donor off the vacuum imaging drum surface which can cause media jams within the image processing apparatus resulting in a loss of the intended image output or, at worse, cause a catastrophic failure to the image processing apparatus.

Known approaches to solving this problem are cumbersome. Adding external clamping components to the vacuum imaging drum would introduce added mechanical complexity to the vacuum imaging drum design and would cause the vacuum imaging drum to be out of round by as much as 80 microns ($\mu$m). This would render the image quality of the intended image to be outside the requirements for the process, since the focus tolerance requirement for the write head which the runout tolerance of the vacuum imaging drum is part of is in the ten micron range (10 $\mu$m) to meet the image quality requirement. Clamps would also have a clearance problem since the working distance of the print head to the surface of the thermal print media loaded on the vacuum imaging drum is approximately 0.030 inches.

Another way to counteract the force pulling the thermal print media receiver and dye donor from the rotating vacuum imaging drum would be to increase the vacuum level in the interior of the vacuum imaging drum. The vacuum is applied to the thermal print media receiver and dye donor by vacuum holes and grooves in the vacuum imaging drum surface. Achieving a higher vacuum comes with some penalties such as: an increase in the cost of the blower that produces the vacuum, complex vacuum coupling adding mechanical noise to the rotation of the vacuum imaging drum, a higher acoustical output of the image processor, as well as higher customer operating costs (electrical consumption of the product is increased). In addition there is a limit to how high the vacuum level can be without distorting the media, hence decreasing the image quality. While the above approaches increase the RPM limit of the vacuum imaging drum to some extent, they do not over come the problem of the physical characteristics of the thermal print media and the dye donor interface with each other and to the circumferential recess.

SUMMARY OF THE INVENTION

It is an object of the present invention to add micro paths to a surface of the vacuum imaging drum to increase the holding force on the thermal print media.

It is also an object of the present invention to provide an increase in throughput of the image processing apparatus by allowing the rotational speed of the vacuum imaging drum to be increased to higher speeds.

It is an object of the present invention to provide an increase in the holding force applied to the thermal print media by varying the degree or roughness of a surface of the vacuum imaging drum by sand blasting, to increase the throughput of the image processing apparatus by allowing the rotational speed of the vacuum imaging drum to be increased to higher speeds.

It is an object of the present invention to provide an increase in throughput of the imaging apparatus and provide an improvement in reliability of an image defect due to the separation of the thermal print media receiver and donor sheet materials.

According to one aspect of the present invention, in an imaging processing apparatus for a thermal print media receiver and dye donors for processing an intended image comprises a vacuum imaging drum for holding two sheets of thermal print media receiver, and dye donor, that limits the throughput of the image processing apparatus. The thermal print media receiver and dye donors are limited to the amount of centrifugal force they can withstand. Subsequently, the RPM of the vacuum imaging drum is limited, thus the throughput of the image processing apparatus is limited. The main mechanism for holding the thermal media to the drum is the vacuum level inside the vacuum imaging drum. Prior art utilizes a uniform cross-section vacuum hole tied to a slot design on the drum surface as the means to convey this vacuum to the thermal print media. Adding a sandblasted surface treatment to selected areas tying into the vacuum holes and slots of the vacuum imaging drum increases the effective area of the thermal print media that the vacuum is applied over and beyond what is obtainable from the prior art. This sandblast treatment provides a micropath for the vacuum to propagate away from the vacuum hole or slot and be applied over a much greater area of thermal print media, resulting in an increase in the vacuum hold down force, thus leading to a higher RPM of the imaging drum and a subsequent increase in throughput of the image processing apparatus while reducing the chance of an image defect due to the separation of the thermal print media receiver and dye donor. By adding a sandblasted finish to specific locations on the surface of the vacuum imaging drum such as just inside the edge of the thermal print media receiver or dye donor providing a seal for the vacuum. In an alternate embodiment the sandblast finish extends just outside of the edge of the thermal print media ensuring that all edges of the media are subject to a vacuum level. The sandblast treatment is to a specified roughness or multiple degrees of roughness, which ensures a negligible amount of air flow leakage out through these edges.

BRIEF DESCRIPTION OF THE DRAWINGS

FIG. 7 is a partial plane view of the vacuum imaging drum showing a corner of the thermal print media receiver and dye donor with the sand blasted surface extending beyond the edge of the media.

FIG. 8 is a partial section view of the vacuum imaging drum showing a vacuum hole in a sand blasted area of the present invention

DETAILED DESCRIPTION OF THE INVENTION

Figure 1:
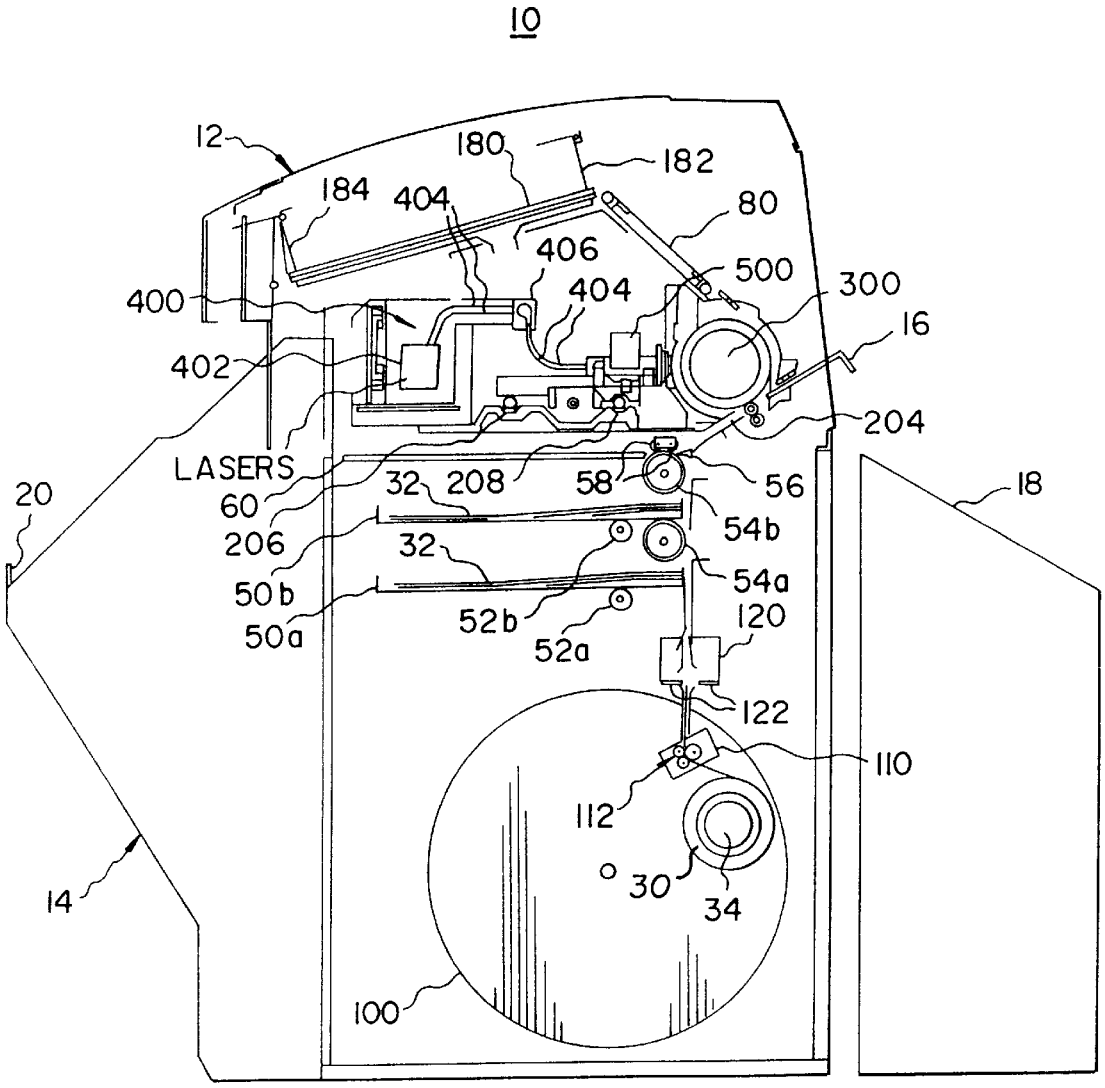
FIG. 1 is a side view in vertical cross section of an image processing apparatus of the present invention.

Referring to FIG. 1, there is illustrated an image processing apparatus 10 according to the present invention having an image processor housing 12 which provides a protective cover. A movable, hinged image processor door 14 is attached to the front portion of the image processor housing 12, permitting access to the two sheet material trays lower sheet material tray 50*a* and upper sheet material tray 50*b*, that are positioned in the interior portion of the image processor housing 12 for supporting thermal print media 32, thereon. Only one of the sheet material trays will dispense the thermal print media 32 to create an intended image thereon; the alternate sheet material tray either holds an alternative type of thermal print media 32 or functions as a back up tray. In this regard, the lower sheet material tray 50*a* includes a lower media lift cam 52*a* for lifting the thermal print media 32 upwardly toward a rotatable, lower media roller 54*a* and, ultimately, toward a second rotatable, upper media roller 54*b* which, when both are rotated, permits the thermal print media 32 to be pulled upwardly towards a media guide 56. The upper sheet material tray 50*b* includes a upper media lift cam 52*b* for lifting the thermal print media 32 towards the upper media roller 54*b* which directs it towards the media guide 56.

The movable media guide 56 directs the thermal print media 32 under a pair of media guide rollers 58 which engages the thermal print media 32 for assisting the upper media roller 54*b* in directing it on to the media staging tray 60. The media guide 56 is attached and hinged at one end to the lathe bed scanning frame 202 (shown in FIG. 2), and is uninhibited at its other end for permitting multiple positioning of the media guide 56. The media guide 56 then rotates its uninhibited end downwardly, as illustrated in the position shown, and the direction of rotation of the upper media roller 54*b* is reversed for forcing the thermal print media 32 resting on the media staging tray 60 under the pair of media guide rollers 58, upwardly through an entrance passageway 204 and around a rotatable vacuum imaging drum 300.

A roll 30 of dye donor 34 is connected to the media carousel 100 in a lower portion of the image processor housing 12. Four rolls are used, but only one is shown for clarity. Each roll includes a dye donor 34 of a different color, typically black, yellow, magenta and cyan. These dye donors 34 are ultimately cut into dye donor sheets 36 and passed to the vacuum imaging drum 300 for forming a media from which dyes imbedded therein are passed to the thermal print media 32 resting thereon, which process is described in detail herein below. In this regard, a media drive mechanism 110 is attached to roll of thermal print media donor roll 30, and includes three media drive rollers 112 through which the dye donor of interest is metered upwardly into a media knife assembly 120. After the dye donor reaches a predetermined position, the media drive rollers 112 cease driving the dye donor 34 and the two media knife blades 122 positioned at the bottom portion of the media knife assembly 120 cut the dye donor into dye donor sheets 36. The lower media roller 54*a* and the upper media roller 54*b* along with the media guide 56 then pass the dye donor 34 onto media staging tray 60 and ultimately onto the vacuum imaging drum 300 and in registration with the thermal print media 32 using the same process as described above for passing the thermal print media 32 onto the vacuum imaging drum 300. The dye donor 34 now rests atop the thermal print media 32 with a narrow gap between the two created by microbeads imbedded into the thermal print media 32.

A laser diodes assembly 400 includes a quantity of lasers 402 in its interior, the laser diodes 402 are connected via fiber optic cables 404 to a distribution block 406 and ultimately to the printhead 500. The printhead 500 directs thermal energy received from the laser diodes 402 causing the dye donor sheet 36 to pass the desired color across the gap to the thermal print media 32. The printhead 500 is attached to a lead screw 250 via the lead screw drive nut 254 and drive coupling 256 (not shown in FIG. 1) for permitting movement axially along the longitudinal axis of the vacuum imaging drum 300 for transferring the data to create the intended image onto the thermal print media 32.

For writing, the vacuum imaging drum 300 rotates at a constant velocity, and the printhead 500 begins at one end of the thermal print media 32 and traverse the entire length of the thermal print media 32 for completing the transfer process for the particular dye donor sheet 36 resting on the thermal print media 32. After the printhead 500 has completed the transfer process, for the particular dye donor sheet 36 resting on the thermal print media 32 the dye donor sheet 36 is then removed from the vacuum imaging drum 300 and transferred out the image processor housing 12 via a skive or ejection chute 16. The dye donor sheet 36 eventually comes to rest in a waste bin 18 for removal by the user. The above described process is then repeated for the other three rolls of dye donor 34.

After the color from all four sheets of dye donor sheet 36 have been transferred and the dye donor sheet 36 removed from the vacuum imaging drum 300, the thermal print media 32 is removed from the vacuum imaging drum 300 and transported via a transport mechanism 80 to a color binding assembly 180. The entrance door 182 of the color binding assembly 180 is opened for permitting the thermal print media 32 to enter the color binding assembly 180, and shuts once the thermal print media 32 comes to rest in the color binding assembly 180. The color binding assembly 180 processes the thermal print media 32 for further binding the transferred colors on the thermal print media receiver material 32 and for sealing the microbeads thereon. After the color binding process has been completed, the media exit door 184 is opened and the thermal print media 32 with the intended image thereon passes out of the color binding assembly 180 and the image processor housing 12 and comes to rest against a media stop 20.

Figure 2:
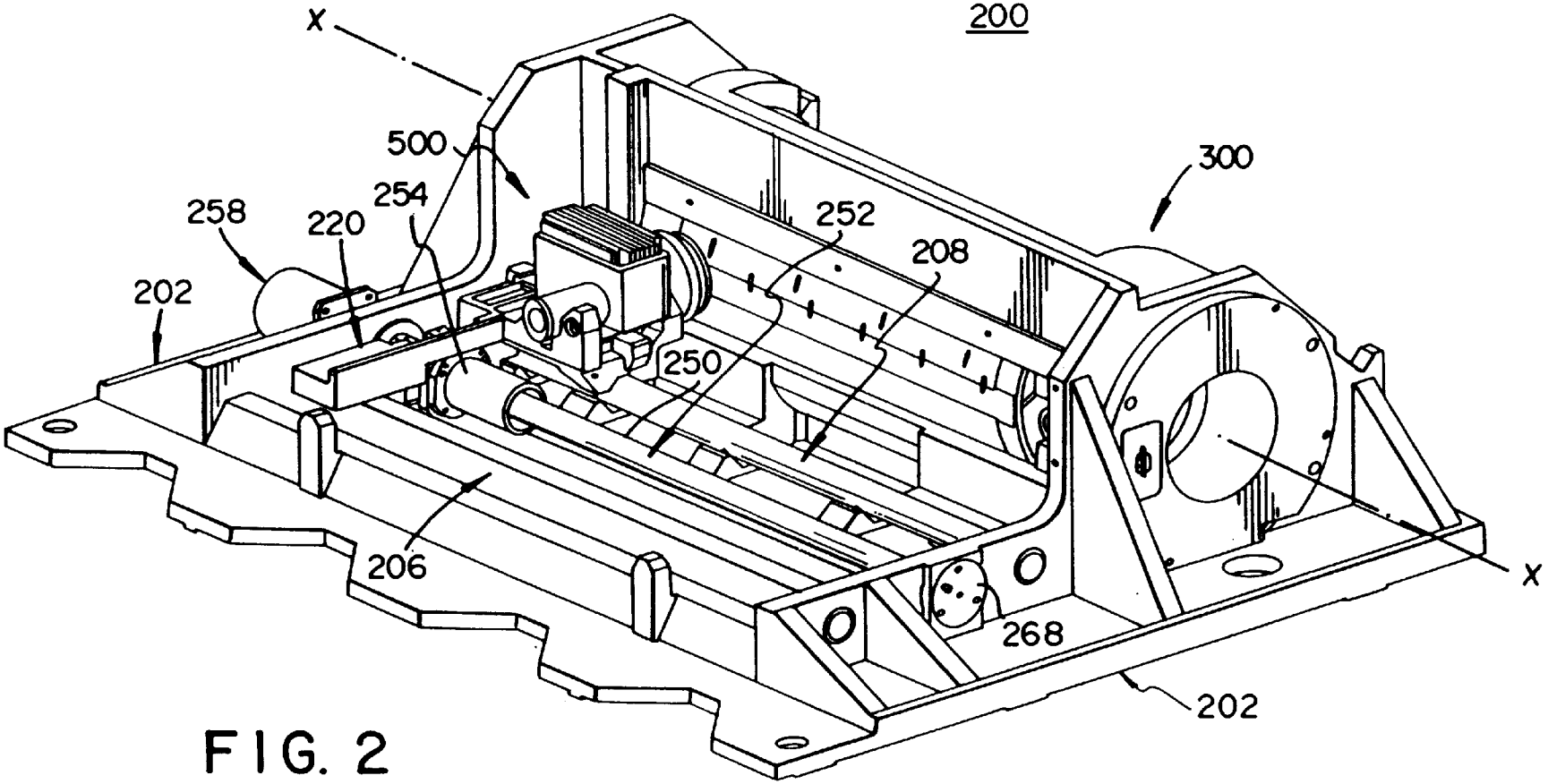
FIG. 2 is a perspective view of the lathe bed scanning subsystem or write engine of the present invention.

Referring to FIG. 2, there is illustrated a perspective view of the lathe bed scanning subsystem 200 of the image processing apparatus 10, including the vacuum imaging drum 300, printhead 500 and lead screw 250 assembled in the lathe bed scanning frame 202. The vacuum imaging drum 300 is mounted for rotation about an axis in the lathe bed scanning frame 202. The printhead 500 is movable with respect to the vacuum imaging drum 300, and is arranged to direct a beam of light to the dye donor sheet 36. The beam of light from the printhead 500 for each laser diode 402 is modulated individually by modulated electronic signals from the image processing apparatus 10, which are representative of the shape and color of the original image, so that each color on the dye donor sheet 36 is heated to cause volatilization only in those areas in which its presence is required on the thermal print media 32 to reconstruct the shape and color of the original image.

The printhead 500 is mounted on a movable translation stage member 220 which, in turn, is supported for low friction slidable movement on translation bearing rods 206 and 208. The translation bearing rods 206 and 208 are sufficiently rigid so that they do not sag or distort between their mounting points and are arranged as parallel as possible with the axis of the vacuum imaging drum 300 with the axis of the printhead 500 perpendicular to the axis of the vacuum imaging drum 300 axis. The front translation bearing rod 208 locates the translation stage member 220 in the vertical and the horizontal directions with respect to axis of the vacuum imaging drum 300. The rear translation bearing rod 206 locates the translation stage member 220 only with respect to rotation of the translation stage member 220 about the front translation bearing rod 208 so that there is no over-constraint condition of the translation stage member 220 which might cause it to bind, chatter, or otherwise impart undesirable vibration or jitters to the printhead 500 during the generation of an intended image.

Figure 3:
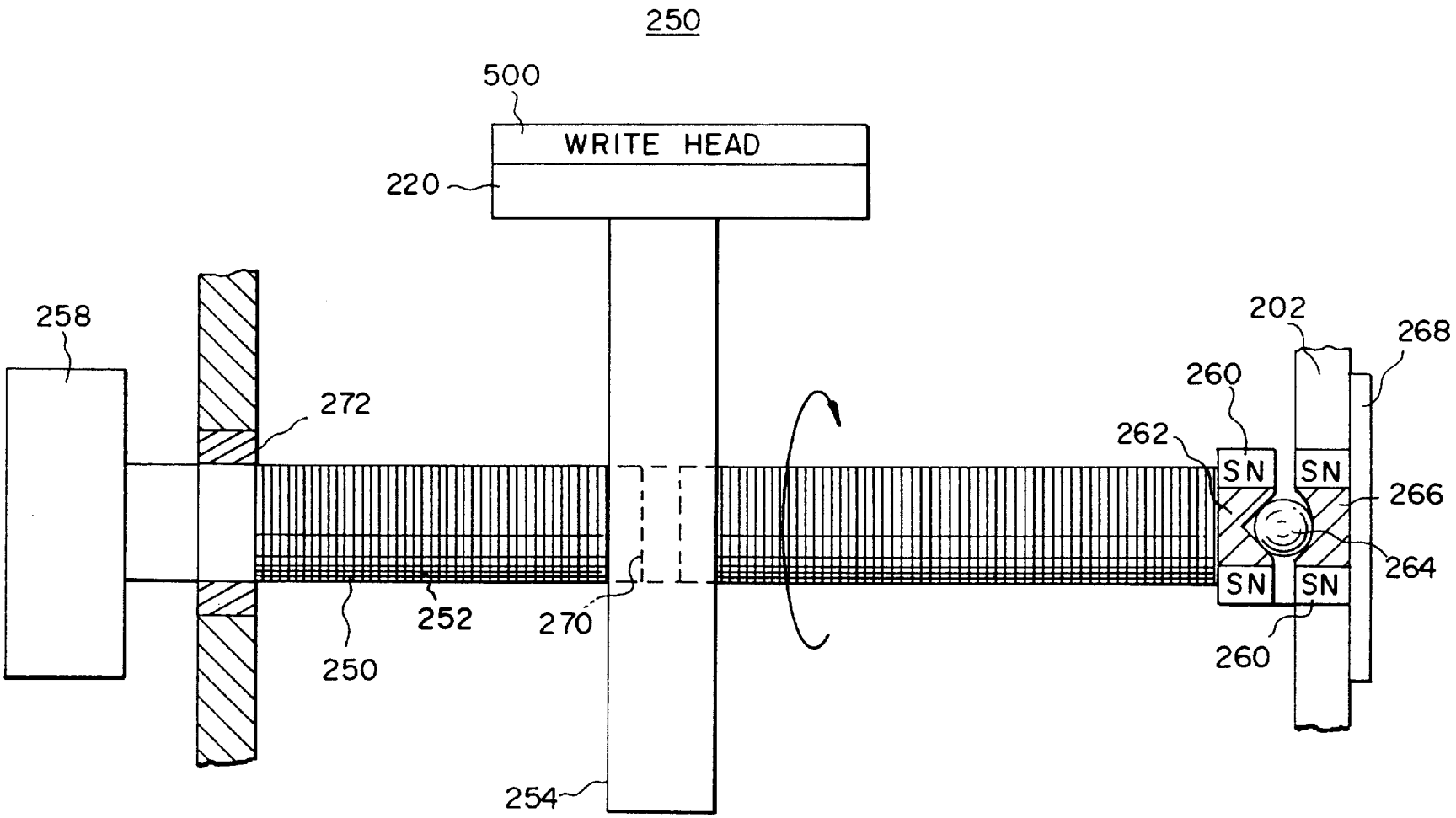
FIG. 3 is a top view in horizontal cross section, partially in phantom, of the lead screw of the present invention.

Referring to FIGS. 2 and 3, a lead screw 250 is shown which includes an elongated, threaded shaft 252 which is attached to the linear drive motor 258 on its drive end and to the lathe bed scanning frame 202 by means of a radial bearing 272. A lead screw drive nut 254 includes grooves in its hollowed-out center portion not shown for mating with the threads of the threaded shaft 252 for permitting the lead screw drive nut 254 to move axially along the threaded shaft 252 as the threaded shaft 252 is rotated by the linear drive motor 258. The lead screw drive nut 254 is integrally attached to the printhead 500 through the lead screw coupling 256 (not shown) and the translation stage member 220 at its periphery so that as the threaded shaft 252 is rotated by the linear drive motor 258 the lead screw drive nut 254 moves axially along the threaded shaft 252 which in turn moves the printhead 500 axially along the vacuum imaging drum 300.

As best illustrated in FIG. 3, an annular-shaped axial load magnet 260*a* is integrally attached to the driven end of the threaded shaft 252, and is in a spaced apart relationship with another annular-shaped axial load magnet 260*b* attached to the lathe bed scanning frame 202. The axial load magnets 260*a* and 260*b* are preferably made of rare-earth materials such as neodymium-iron-boron. A generally circular-shaped boss 262 part of the threaded shaft 252 rests in a hollowed-out portion 270 of the annular-shaped axial load magnet 260*a,* and includes a generally V-shaped surface at the end for receiving a ball bearing 264. A circular-shaped insert 266 is placed in the other annular-shaped axial load magnet 260*b,* and includes an accurate-shaped surface on one end for receiving the ball bearing 264, and a flat surface at its other end for receiving an end cap 268 placed over the annular-shaped axial load magnet 260*b* and attached to the lathe bed scanning frame 202 for protectively covering the annular-shaped axial load magnet 260*b* and providing an axial stop for the lead screw 250. The circular shaped insert 266 is preferably made of material such as Rulon J or Delrin AF, both well known in the art.

The lead screw 250 operates as follows. The linear drive motor 258 is energized and imparts rotation to the lead screw 250, as indicated by the arrows, causing the lead screw drive nut 254 to move axially along the threaded shaft 252. The annular-shaped axial load magnets 260*a* and 260*b* are magnetically attracted to each other which prevents axial movement of the lead screw 250. The ball bearing 264, however, permits rotation of the lead screw 250 while maintaining the positional relationship of the annular-shaped axial load magnets 260, i.e., slightly spaced apart, which prevents mechanical friction between them while obviously permitting the threaded shaft 252 to rotate.

The print head 500 travels in a path along the vacuum imaging drum 300, while being moved at a speed synchronous with the vacuum imaging drum 300 rotation and proportional to the width of the writing swath. The pattern that the print head 500 transfers to the thermal print media 32 along the vacuum imaging drum 300, is a helix.

Figure 4:
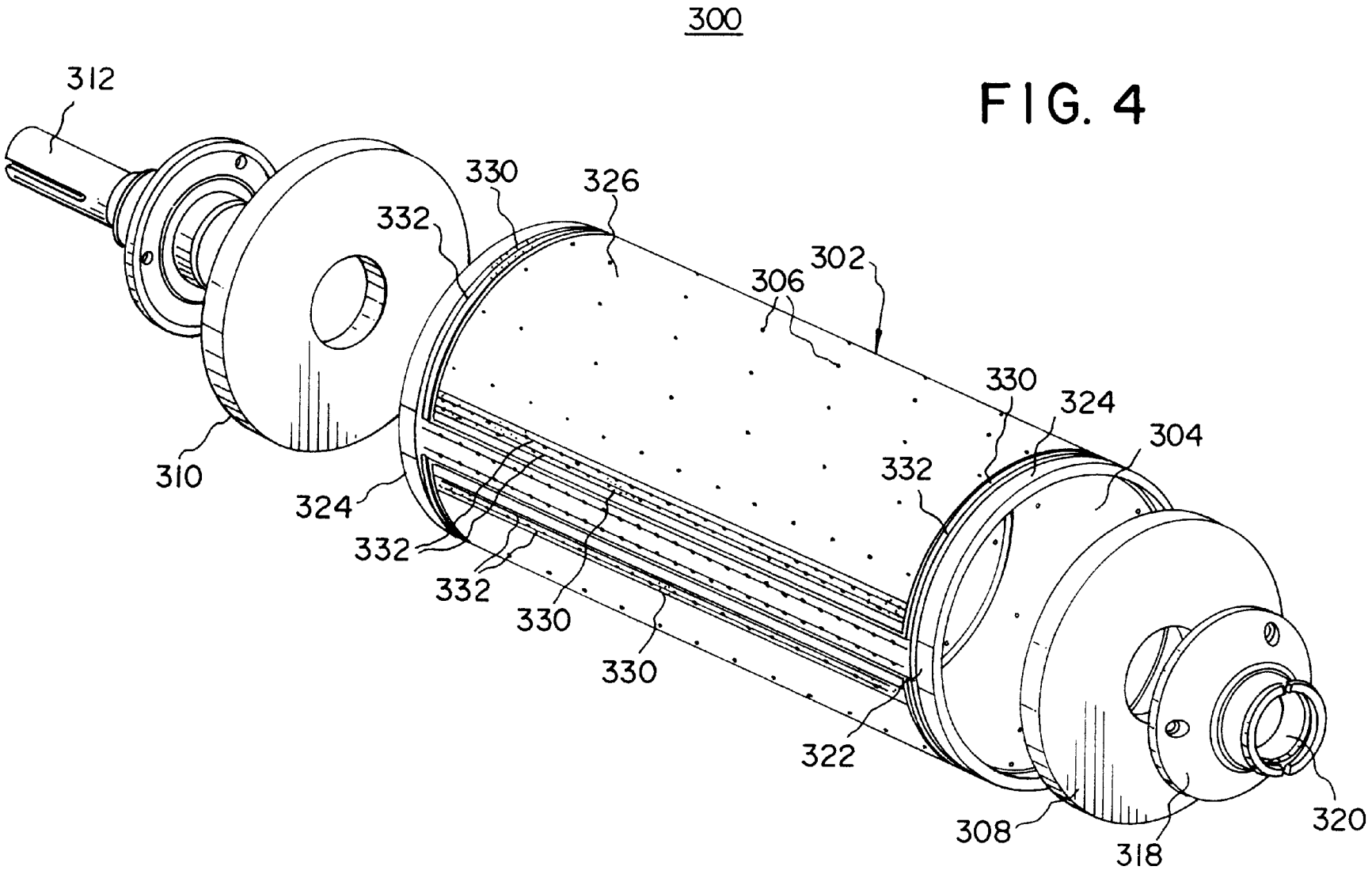
FIG. 4 is a exploded, perspective view of the vacuum imaging drum of the present invention.

Referring to FIG. 4, there is illustrated an exploded view of the vacuum imaging drum 300. The vacuum imaging drum 300 has a cylindrical shaped vacuum drum housing 302 that has a hollowed-out interior portion 304, and further includes a plurality of vacuum groves 332 and vacuum holes 306 which extend through the vacuum drum housing 302 for permitting a vacuum to be applied from the hollowed-out interior portion 304 of the vacuum imaging drum 300 for supporting and maintaining position of the thermal print media 32, and dye donor sheet 36, as the vacuum imaging drum 300 rotates.

The ends of the vacuum imaging drum 300 are closed by the vacuum end plate 308, and the drive end plate 310. The drive end plate 310, is provided with a centrally disposed drive spindle 312 which extends outwardly therefrom through a support bearing 314, and is stepped down to receive a drive motor armature 316 (which is not shown), the vacuum end plate 308 is provided with a centrally disposed vacuum spindle 318 which extends outwardly therefrom through another support bearing 314.

The drive end spindle 312 extends through the support bearing 314 and is stepped down to receive a DC drive motor armature 316 which is held on by means of a drive nut 342. A DC motor stator 342 is sationarily held by the lathe bed scanning frame member 202, encircling the DC drive motor armature 316 to form a reversible, variable speed DC drive motor for the vacuum imaging drum 300. At the end of the drive spindle 312 an encoder 344 is mounted to provide the timing signals to the image processing apparatus 10.

The opposite spindle is provided with a central vacuum opening 320, which is in alignment with a vacuum fitting 222 with an external flange that is rigidly mounted to the lathe bed scanning frame 202. The vacuum fitting 222 has an extension which extends within but is closely spaced from the vacuum spindle 318, thus forming a small clearance. With this configuration, a slight vacuum leak is provided between the outer diameter of the vacuum fitting 222 and the inner diameter of the opening of the vacuum spindle 318. This assures that no contact exists between the vacuum fitting 222 and the vacuum imaging drum 300 which might impart uneven movement or jitters to the vacuum imaging drum 300 during its rotation. The opposite end of the vacuum fitting 222 is connected to a high-volume vacuum pump which in this configuration, is capable of producing 50–60 inches of water at a volume of 60–70 cfm.

Figure 5:
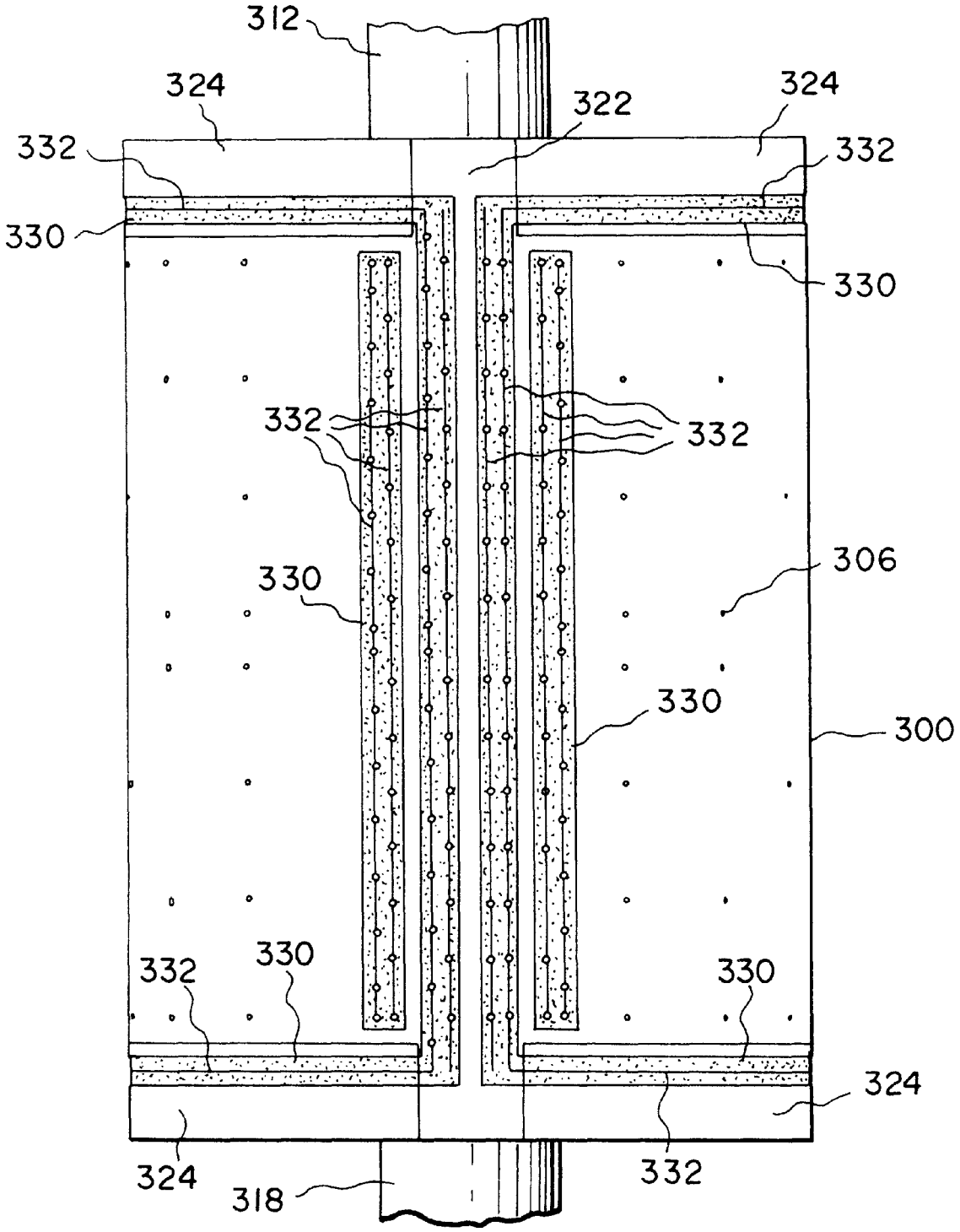
FIG. 5 is a plane view of the vacuum imaging drum surface of the present invention.

The outer surface of the vacuum imaging drum 300 is provided with an axially extending flat 322, shown in FIG. 5, which extends over approximately 8 degrees of the vacuum imaging drum 300 circumference. The vacuum imaging drum 300 is also provided with donor support rings 324 which form a circumferential recess 326 which extends circumferentially from one side of the axially extending flat 322 circumferentially around the vacuum imaging drum 300 to the other side of the axially extending flat 322, and from approximately one inch from one end of the vacuum imaging drum 300 to approximately one inch from the other end of the vacuum imaging drum 300.

Figure 6A:
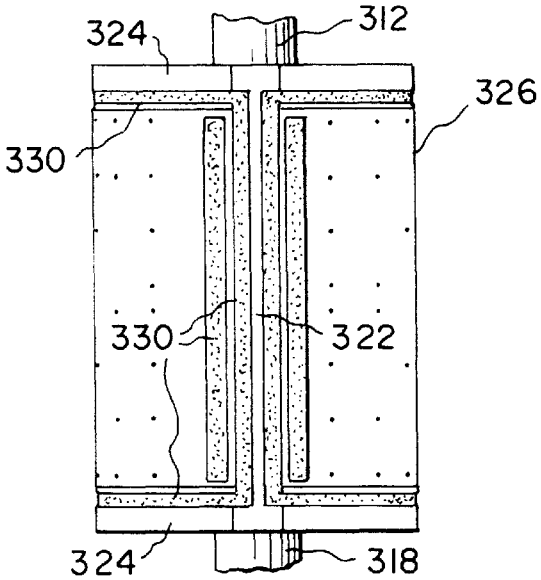
FIGS. 6*a*–6*c* are plane views of the vacuum imaging drum showing the sequence of placement for the thermal print media and dye donor.
Figure 6B:
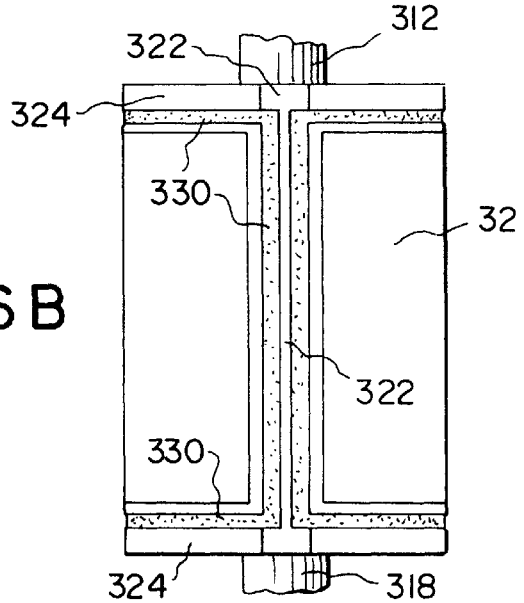
Figure 6C:
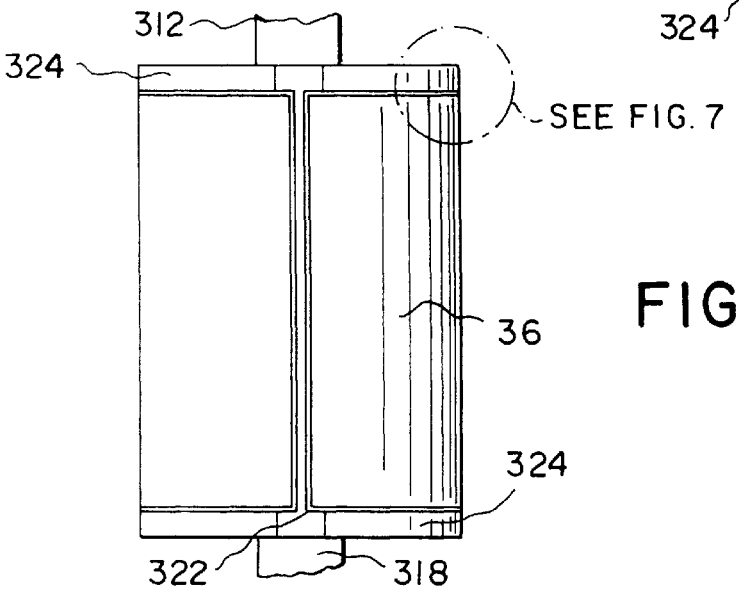

The thermal print media 32 when mounted on the vacuum imaging drum is seated within the circumferential recess 326 as shown in FIGS. 6A–6C and therefor the donor support rings 324 have a thickness substantially equal to the thermal print media 32 thickness seated there between which is approximately 0.004 inches in thickness. The purpose of the vacuum imaging drum 300 axially extending flat 322 is two fold, it assures that the leading and trailing ends of the dye donor sheet 36 are somewhat protected from the effect of the air during the relatively high speed rotation that the vacuum imaging drum 300 undergoes during the imaging process. Thus the air will have less tendency to lift the leading or trailing edges of the dye donor sheet 36, also the vacuum imaging drum 300 axially extending flat 322 ensures that the leading and trailing ends of the dye donor sheet 36 are recessed from the vacuum imaging drum 300 periphery. This reduces the chance that the thermal print media 32 and dye donor sheets 36 can not come in contact with other parts of the image processing apparatus 10, such as the printhead 500, causing a jam and possible loss of the intended image or worse catastrophic damage to the image processing apparatus 10.

The selected sandblasted areas 330 located on the surface of the vacuum imaging drum 300, shown in FIGS. 7 and 8, provide a vacuum path from the vacuum slots 332 and the vacuum hole 306 to selected areas of the thermal print media 32 and dye donor sheets 36 that otherwise would have no vacuum applied to that respective area.

The vacuum imaging drum 300 axially extending flat 322 also ensures that the leading and trailing ends of the thermal print media 32 and dye donor sheets 36 are recessed from the vacuum imaging drum 300 periphery. This reduces the chance that the thermal print media 32 and dye donor sheets 36 can not come in contact with other parts of the image processing apparatus, such as the print head, causing a jam and possible loss of the intended image or worse, catastrophic damage to the image processing apparatus 10.

The purpose of the circumferential recess 326 on the vacuum imaging drum 360 surface is to eliminate any creases in the dye donor sheets 36, as they are drawn down over the thermal print media 32 during the loading of the dye donor sheet 36. This assures that no folds or creases will be generated in the dye donor sheet 36 which could extend into the image area and seriously adversely affect the intended image. The circumferential recess 326 also substantially eliminates the entrapment of air along the edge of the thermal print media 32, where it is difficult for the vacuum holes 306 in the vacuum imaging drum 300 surface to assure the removal of the entrapped air. Any residual air between the thermal print media 32 and the dye donor sheets 36, can also adversely affect the intended image. Addition of the sandblast area 330 would prevent this problem.

The invention has been described with reference to the preferred embodiment thereof. However, it will be appreciated and understood that variations and modifications can be effected within the spirit and scope of the invention as described herein above and as defined in the appended claims by a person of ordinary skill in the art without departing from the scope of the invention. For example, the invention is applicable to any drum, whether the drum holds the imaging media on an external surface as described above or the drum holds the imaging media internally. In addition, selected vacuum holes have a sandblasted surface treatment around them that extends past the edges of the thermal print media. Also, the dye donor may have dye, pigments, or other material which is transferred to the thermal print media. Thermal print media includes paper, films, plates, and other material capable of accepting an image.

Parts List

| | |
|---|---|
| 10 | Image processing apparatus |
| 12 | Image processor housing |
| 14 | Image processor door |
| 16 | Donor ejection chute |
| 18 | Donor waste bin |
| 20 | Media stop |
| 30 | Dye donor roll |
| 32 | Thermal print media |
| 34 | Dye donor |
| 36 | Dye donor sheets |
| 50a | Lower sheet material tray |
| 50b | Upper sheet material tray |
| 52 | Media lift cams |
| 52a | Lower media lift cam |
| 52b | Upper media lift cam |
| 54a | Lower media roller |
| 54b | Upper media roller |
| 56 | Media guide |
| 58 | Media guide rollers |
| 60 | Media staging tray |
| 80 | Transport mechanism |
| 100 | Media carousel |
| 110 | Media drive mechanism |
| 112 | Media drive rollers |
| 114 | Contoured ends |
| 120 | Media knife assembly |
| 122 | Media knife blades |
| 180 | Color binding assembly |
| 182 | Media entrance door |
| 184 | Media exit door |
| 200 | Lathe bed scanning subsystem |
| 202 | Lathe bed scanning frame |
| 204 | Entrance passageway |
| 206 | Rear translation bearing rod |
| 208 | Front translation bearing rod |
| 220 | Translation stage member |
| 222 | Vacuum fitting |
| 224 | Vacuum blower |
| 250 | Lead screw |
| 252 | Threaded shaft |
| 254 | Lead screw drive nut |
| 256 | Drive coupling |

-continued

| Parts List | |
|---|---|
| 258 | Linear drive motor |
| 260 | Axial load magnets |
| 260a | Axial load magnet |
| 260b | Axial load magnet |
| 262 | Circular-shaped boss |
| 264 | Ball bearing |
| 266 | Circular-shaped insert |
| 268 | End cap |
| 270 | Hollowed-out center portion |
| 272 | Radial bearing |
| 300 | Vacuum imaging drum |
| 302 | Vacuum drum housing |
| 304 | Hollowed out interior portion |
| 306 | Vacuum hole |
| 308 | Vacuum end plate |
| 310 | Drive end plate |
| 312 | Drive spindle |
| 314 | Support bearing |
| 316 | Drive motor armature |
| 318 | Vacuum spindle |
| 320 | Central vacuum opening |
| 322 | Axially extending flat |
| 324 | Donor support ring |
| 326 | Cicumferential recess |
| 330 | Sand Blasted Area |
| 332 | Vacuum grooves |
| 340 | Drive nut |
| 342 | DC motor stator |
| 344 | Drum encoder |
| 400 | Laser assembly |
| 402 | Lasers diode |
| 404 | Fiber optic cables |
| 406 | Distribution block |
| 500 | Printhead |

We claim:

1. An image processing apparatus for writing images to a thermal print media comprising:

a vacuum imaging drum;

a printhead mounted adjacent to said vacuum imaging drum and having a plurality of light sources;

a lead screw for moving said printhead in a first direction parallel to a longitudinal axis of said imaging drum;

thermal print media mounted on said imaging drum; and a motor for rotating said imaging drum;

said vacuum imaging drum having a sandblasted surface section which defines a rough surface that forms randomly oriented micropaths over at least a portion of a surface of said vacuum imaging drum.

2. An image processing apparatus according to claim 1 wherein said micropaths extend past an edge of said thermal print media.

3. An image processing apparatus according to claim 1 wherein said thermal print media is covered by a dye donor.

4. An image processing apparatus according to claim 3 wherein said micropaths extend past an edge of said dye donor.

5. An image processing apparatus according to claim 1 wherein said vacuum imaging drum has at least one vacuum hole in said surface.

6. An image processing apparatus according to claim 1 wherein said vacuum imaging drum has at least one vacuum slot in said surface.

7. An image processing apparatus according to claim 1 wherein a plurality of lasers are connected to said printhead by a plurality of fiber-optics to produce said light sources.

8. An image processing apparatus according to claim 1 wherein said image processing apparatus is a color proofer.

9. An image processing apparatus according to claim 1 wherein said image processing apparatus is a laser thermal printer.

10. An image processing apparatus according to claim 1 wherein a donor overlays said thermal print media and said printhead writes an image to said thermal print media by transferring a color from said donor to said thermal print media.

11. A method of writing a direct image or a mirror image to a thermal print media, the method comprising the steps of:

securing said thermal print media to an imaging drum;

securing a first donor sheet on top of said thermal print media;

rotating said imaging drum wherein said imaging drum has a sandblasted surface section which defines a rough surface that forms randomly oriented micropaths on at least a portion of a surface of said imaging drum;

moving a printhead in a horizontal direction along a line approximately parallel to a centerline of rotation of said imaging drum; and transmitting an image signal to said printhead, causing said printhead to emit beams of light forming an image on said thermal print medium.

12. A vacuum imaging drum adapted to hold at least one sheet of material on a surface of said vacuum imaging drum, comprising:

a cylindrical drum mounted for rotation, said vacuum imaging drum having a sandblasted surface section which defines a rough surface that forms randomly oriented micropaths over at least a portion of a surface of said vacuum imaging drum.

13. A vacuum imaging drum according to claim 12 wherein said vacuum imaging drum has at least one vacuum hole in said surface.

14. A vacuum imaging drum according to claim 12 wherein said vacuum imaging drum has at least one vacuum slot in said surface.

15. An image processing apparatus for writing images to a print media comprising:

a vacuum imaging drum; and a printhead mounted adjacent to said vacuum imaging drum so as to be movable in a direction parallel to a longitudinal axis of said vacuum imaging drum;

said vacuum imaging drum having a surface onto which print media is mounted, said surface comprising vacuum holes through which vacuum is applied to the print media and sandblasted sections that define a rough surface which forms randomly oriented micropaths, said micropaths causing vacuum from said vacuum holes to propagate away from said vacuum holes so as to increase an area of the print media to which the vacuum is applied.

16. An image processing apparatus according to claim 15 wherein said vacuum holes lead to vacuum grooves on the surface of said vacuum imaging drum.

17. A vacuum imaging drum according to claim 16, wherein said vacuum holes lead to vacuum grooves on the surface of the cylindrical drum.

18. A vacuum imaging drum adapted to hold at least one sheet of material on a surface of said vacuum imaging drum, comprising:

a cylindrical drum mounted for rotation, said cylindrical drum having a surface adapted to receive print media thereon, said surface comprising vacuum holes through which vacuum is applied to the print media and sand-blasted sections that define a rough surface which forms randomly oriented micropaths, said micropaths causing vacuum from said vacuum holes to propagate away from said vacuum holes to increase an area of the print media to which the vacuum is applied.

* * * * *